US010077599B2

(12) United States Patent
Goldberg

(10) Patent No.: US 10,077,599 B2
(45) Date of Patent: Sep. 18, 2018

(54) BATTEN SPACERS FOR SHADE SYSTEMS

(71) Applicant: Hunter Douglas, Inc., Pearl River, NY (US)

(72) Inventor: Michael S. Goldberg, Stanley, NC (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 15/156,449

(22) Filed: May 17, 2016

(65) Prior Publication Data

US 2016/0258210 A1 Sep. 8, 2016

Related U.S. Application Data

(63) Continuation-in-part of application No. 14/941,381, filed on Nov. 13, 2015.

(60) Provisional application No. 62/081,554, filed on Nov. 18, 2014, provisional application No. 62/081,456, filed on Nov. 18, 2014.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/262*** | (2006.01) |
| ***E06B 9/38*** | (2006.01) |
| ***E06B 9/384*** | (2006.01) |

(52) U.S. Cl.

CPC ..... *E06B 9/262* (2013.01); *E06B 9/38* (2013.01); *E06B 9/384* (2013.01); *E06B 2009/2622* (2013.01)

(58) Field of Classification Search

CPC .... E06B 9/262; E06B 2009/2622; E06B 9/38; E06B 9/384; E06B 209/2627; E06B 2009/2625; E06B 9/26; E06B 9/2326; E06B 9/326; A47H 3/10; A47H 3/02; A47H 3/00

See application file for complete search history.

(56) References Cited

U.S. PATENT DOCUMENTS

| | | | | |
|---|---|---|---|---|
| 5,273,096 | A * | 12/1993 | Thomsen | E06B 9/262 160/264 |
| 6,257,300 | B1 * | 7/2001 | Brownlie | A47H 23/00 160/264 |
| 8,540,006 | B1 * | 9/2013 | Vestal | E06B 9/38 160/340 |
| 2004/0108078 | A1 * | 6/2004 | Chen | E06B 9/262 160/84.01 |

(Continued)

*Primary Examiner* — Katherine W Mitchell
*Assistant Examiner* — Jeremy C Ramsey
(74) *Attorney, Agent, or Firm* — Dority & Manning, P.A.

(57) ABSTRACT

In one aspect, a shade assembly may generally include a shade fabric having a front side and a back side. The shade assembly may also include two or more batten spacers, with each batten spacer being coupled to the shade fabric at spaced apart locations along a vertical length of the fabric. Moreover, the batten spacers may be substantially aligned with one another horizontally along the back side of the shade fabric. When the shade fabric is moved to an opened position, the batten spacers may be configured to vertically engage one another to form a vertical spacer stack along the back side of the shade fabric.

22 Claims, 10 Drawing Sheets

(56) References Cited

U.S. PATENT DOCUMENTS

| | | | | |
|---|---|---|---|---|
| 2011/0048652 | A1* | 3/2011 | Chen | E06B 9/262 160/84.04 |
| 2011/0067820 | A1* | 3/2011 | Hsu | E06B 9/262 160/84.03 |
| 2012/0031569 | A1* | 2/2012 | Elinson | E06B 9/262 160/127 |
| 2012/0193043 | A1 | 8/2012 | Bishop et al. | |
| 2015/0075726 | A1* | 3/2015 | Byun | E06B 9/262 160/84.04 |

* cited by examiner

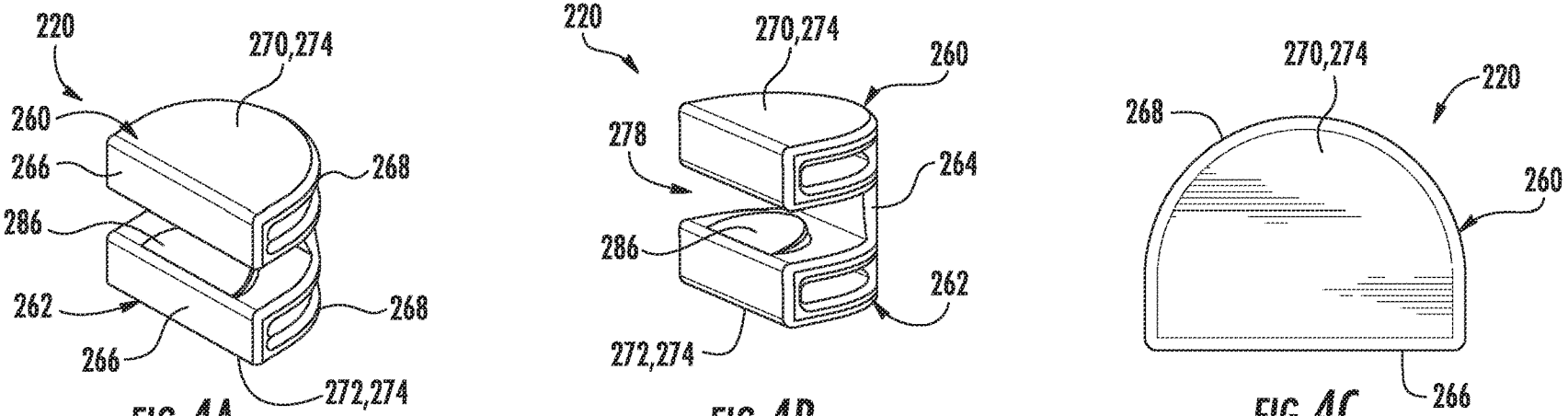
FIG. 4A
FIG. 4B
FIG. 4C
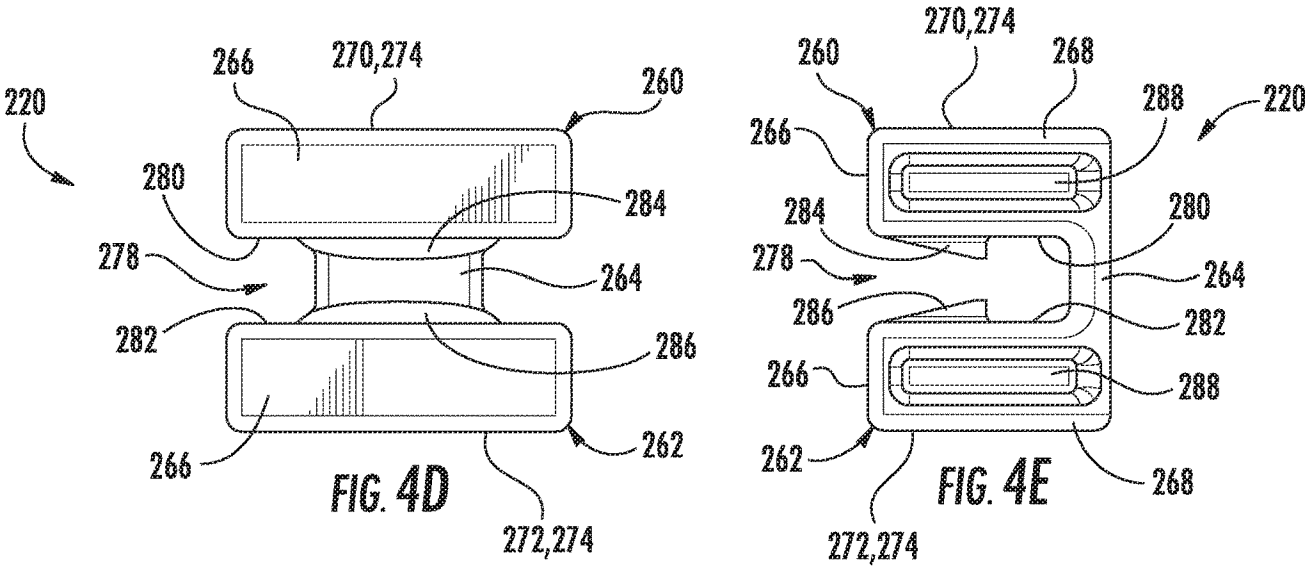
FIG. 4D
FIG. 4E

BATTEN SPACERS FOR SHADE SYSTEMS

CROSS-REFERENCE TO RELATED APPLICATIONS

The present application is a continuation-in-part of U.S. patent application Ser. No. 14/941,381, filed on Nov. 13, 2015, which is, in turn, based upon and claims priority to and the benefit of the earlier filing dates of U.S. Provisional Patent Application No. 62/081,456, filed on Nov. 18, 2014, and U.S. Provisional Patent Application No. 62/081,554, filed on Nov. 18, 2014, the disclosures of all of which are hereby incorporated by reference herein in their entirety for all purposes.

FIELD OF THE INVENTION

The present subject matter relates generally to coverings for architectural openings and, more particularly, to batten spacers for use in coverings for architectural openings, such as blinds, blind systems, shades, shade systems, shade assemblies (herein "shade assemblies" for the sake of convenience without intent to limit), including roman shade assemblies and other shade assemblies incorporating battens.

BACKGROUND OF THE INVENTION

Roman window shade systems and assemblies include a shade and/or a backing fabric that is adapted to fold into a plurality of horizontal pleats or folds as the shade is opened. The folds are typically formed using rigid battens that are sewn to the fabric or otherwise coupled to the fabric using a clip or other retaining mechanism. For example, FIG. 1 illustrates a side view of a typical configuration for a roman shade assembly 100, with shade assembly 100 being shown in a fully opened position. As shown, shade assembly 100 includes a shade fabric 106 and a plurality of battens 112 coupled to shade fabric 106 (e.g., via batten clips 114). Additionally, as shown in FIG. 1, when shade assembly 100 is in the opened position, shade fabric 106 forms a plurality of folds 118 along the front side of assembly 100 (e.g., the side facing the interior of the room), with each fold 118 being formed between adjacent battens 112. At such an opened position, battens 112 are typically drawn into a distended configuration that forms a backwards "J-shape" along the back side of shade assembly 100. This can create an aesthetically displeasing appearance for the stacked assembly. Additionally, as the stacked assembly is compressed and forced backwards, one or more portions of shade fabric 106 may come into contact with the surface of an adjacent window (not shown), which can result in condensation from the window being absorbed by shade fabric 106 and may also lead to the stacked assembly being pushed forward relative to the window. Moreover, when in the bunched or distended configuration shown in FIG. 1, shade assembly 100 is often difficult to manipulate and/or release from its opened position.

Accordingly, an improved shade assembly that can be moved to a fully opened positioned without becoming distended in the manner described above would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to batten spacers for use within a shade assembly, such as a shade assembly that includes battens configured to be coupled to a shade fabric. In several embodiments, each batten spacer may be configured to be coupled to a respective batten of the shade assembly. For example, the batten spacers may be configured to be directly or indirectly coupled to respective battens of the shade assembly.

Additionally, in several embodiments, the batten spacers may be configured to be substantially aligned with one another horizontally along a back side of the shade fabric. As such, when the shade fabric is moved to a retracted or raised or opened position, the batten spacers may be configured to vertically engage one another to form a vertical spacer stack along the back side of the shade fabric that maintains the battens in a substantially vertical arrangement relative to one another, such as substantially aligned along a stacking plane.

Moreover, in accordance with aspects of the present subject matter, each batten spacer may define a vertical height. In several embodiments, the height of each batten spacer may be selected based on an effective stacking height of each batten. For instance, in one embodiment, the height of each batten spacer may be substantially equal to or greater than the effective stacking height of each batten.

These and other features, aspects and advantages of the present subject matter will become better understood with reference to the following description and appended claims. The accompanying drawings, which are incorporated in and constitute a part of this specification, illustrate embodiments of the present subject matter and, together with the description, serve to explain the principles of the present subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

FIG. 4A illustrates a perspective view of one illustrative embodiment of a batten clip that may be included within one or more embodiments of the disclosed shade assembly in accordance with aspects of the present subject matter;

FIG. 4B illustrates another perspective view of the batten clip shown in FIG. 4A;

FIG. 4C illustrates a top view of the batten clip shown in FIG. 4A;

FIG. 4D illustrates a front view of the batten clip shown in FIG. 4A;

FIG. 4E illustrates a side view of the batten clip shown in FIG. 4A;

DETAILED DESCRIPTION OF THE INVENTION

Figure 1:
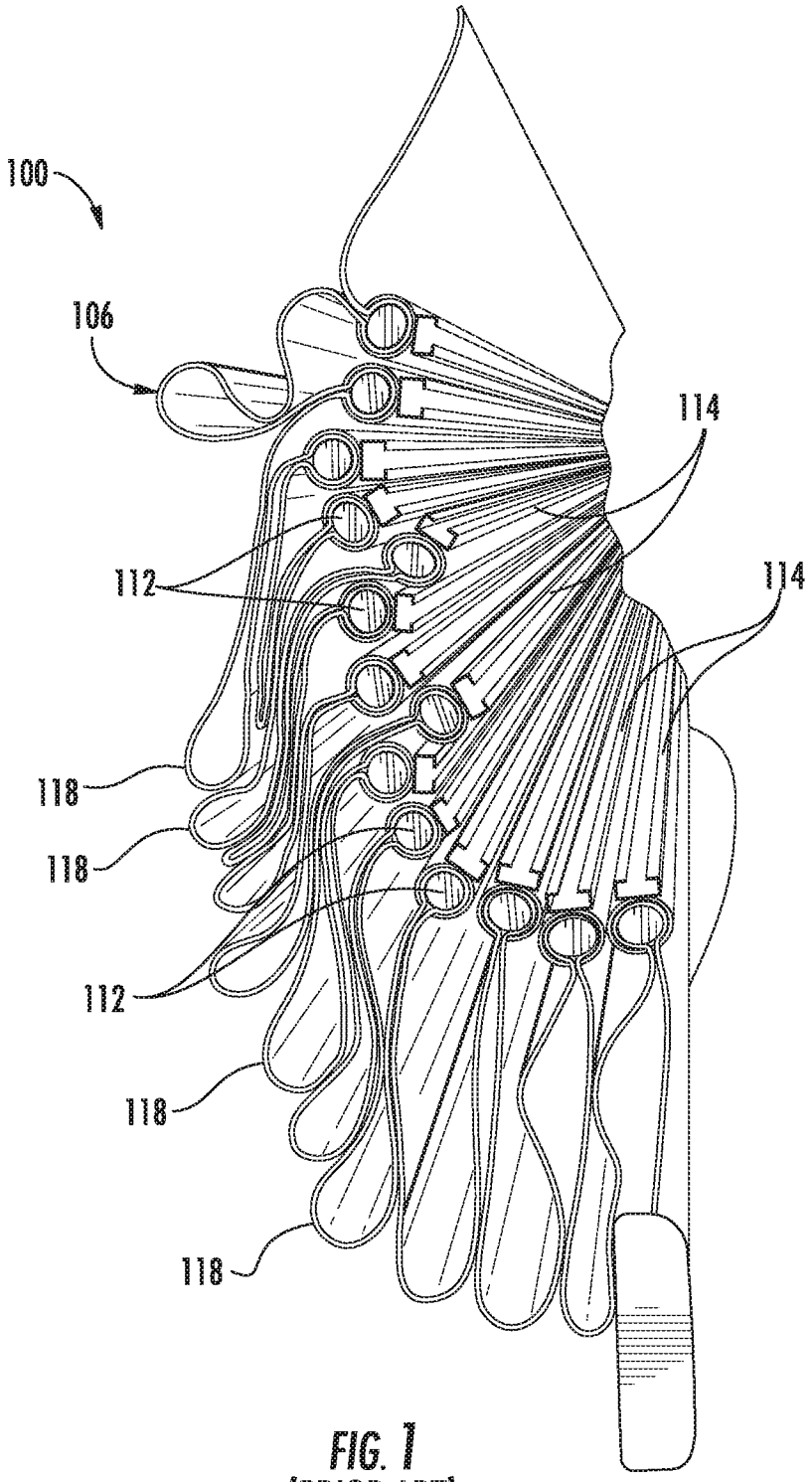
FIG. 1 (PRIOR ART)
FIG. 1 illustrates a side, perspective view of an example of a conventional roman shade assembly, particularly illustrating the shade assembly in a fully opened position.

Reference now will be made in detail to embodiments of the present subject matter, one or more examples of which are illustrated in the drawings. Each example is provided by way of explanation without intent to limit the broad concepts of the present subject matter. In fact, it will be apparent to those skilled in the art that various modifications and variations can be made in the present subject matter without departing from the scope or spirit of the present subject matter. For instance, features illustrated or described as part of one embodiment can be used with another embodiment to yield a still further embodiment. Thus, it is intended that the present subject matter covers such modifications and variations as come within the scope of the appended claims and their equivalents.

In general, the present subject matter is directed to batten spacers for use within a shade assembly, such as a shade assembly including battens configured to be coupled to a shade fabric (e.g., a roman shade assembly). In several embodiments, the batten spacers may be coupled to the battens of the shade assembly such that, when the assembly is moved to its fully retracted or raised or opened (hereinafter "opened" for the sake of simplicity without intent to limit) position, the batten spacers stack-up along the along the back side of the shade fabric, thereby forming a vertical spacer stack that inhibits the battens from becoming distended in the manner described above with reference to FIG. 1. For example, as the shade assembly is lifted to its opened position, adjacent batten spacers may contact or otherwise vertically engage one another. Such vertical engagement of the batten spacers may generally form a semi-rigid or rigid spine extending vertically along the back side of the shade fabric that allows the battens to be maintained in a substantially vertical arrangement, such as by maintaining the battens substantially aligned along a stacking plane.

As will be described below, the disclosed batten spacers may generally have any suitable configuration that allows the spacers to function as described herein. Similarly, each batten spacer may generally be configured to be coupled to its corresponding batten using any suitable means. For example, in embodiments in which the battens are coupled to the shade fabric via batten clips or suitable other retaining mechanisms, each batten spacer may be configured to be coupled to or formed integrally with one of the batten clips. Specifically, in one embodiment, each batten spacer may correspond to a separate component that is configured to be directly or indirectly coupled to a corresponding batten clip of the shade assembly. In another embodiment, the batten clips used to couple the battens to the shade fabric may be designed with integral spacer features. Similarly, in embodiments utilizing sewn-in battens, the batten spacers may be configured to be directly or indirectly coupled to the battens in any suitable manner consistent with the disclosure provided herein.

Additionally, in several embodiments, the height of each batten spacer may be selected such that the batten spacers stack-up vertically along the back side of the shade fabric as the shade assembly is moved to the opened position. For example, in one embodiment, the height of each batten spacer may be selected based on an effective stacking height of the battens. As will be described below, the effective stacking height of the battens may generally correspond to the vertical height that would be defined between adjacent stacking interfaces along the vertical direction of the shade assembly assuming that the battens and any associated components were stacked one on top of another when the shade assembly is moved to its opened position. Thus, in one embodiment, the effective stacking height may correspond to the summation of the dimensions defined by the vertical height of each batten and the vertical thickness of the shade component(s) positioned around such batten, such as the summation of the vertical height of each batten and the collective vertical plane thickness of the shade fabric wrapped directly around the batten (e.g., for sewn-in battens) or the summation of the vertical height of each batten and the collective vertical plane thicknesses of both the shade fabric and the portions of the batten clip wrapped around the batten. By selecting the spacer height for each batten spacer based on the effective stacking height (and/or, optionally, based on the height(s) of other components of the shade assembly (such as the shade material), it can be ensured that the batten spacers vertically engage one another and form a vertical spine along the back side of the shade fabric without the battens becoming distended as the shade assembly is moved to its opened position. In one embodiment, each selected batten spacer may engage the next adjacent batten spacers both above and below the selected batten spacer.

It should be appreciated that, although the present subject matter will generally be described herein with reference to batten spacers that are configured to be coupled to corresponding battens, the disclosed spacers may also be utilized in shade assemblies that do not include or incorporate battens. For instance, techniques are known for forming folds or overlapped portions in a shade fabric at spaced apart vertical locations other than by using battens (e.g., by sewing or adhering the shade fabric together at spaced apart locations). With such shade fabric configurations, the disclosed spacers may, for example, be coupled to the back side of the shade fabric at the locations of the vertically spaced folds or overlapped portions to provide a means for preventing the shade fabric from becoming distended as it is moved to the opened position. Specifically, similar to the embodiments described above, the spacers may be configured to vertically engage one another along the back side of the shade fabric to form a vertical spacer stack or spine that maintains the shade fabric in a substantially vertical arrangement when in the opened position, such as by maintaining the folded or overlapped portions of the shade fabric substantially aligned along a desired stacking plane.

Figure 2A:
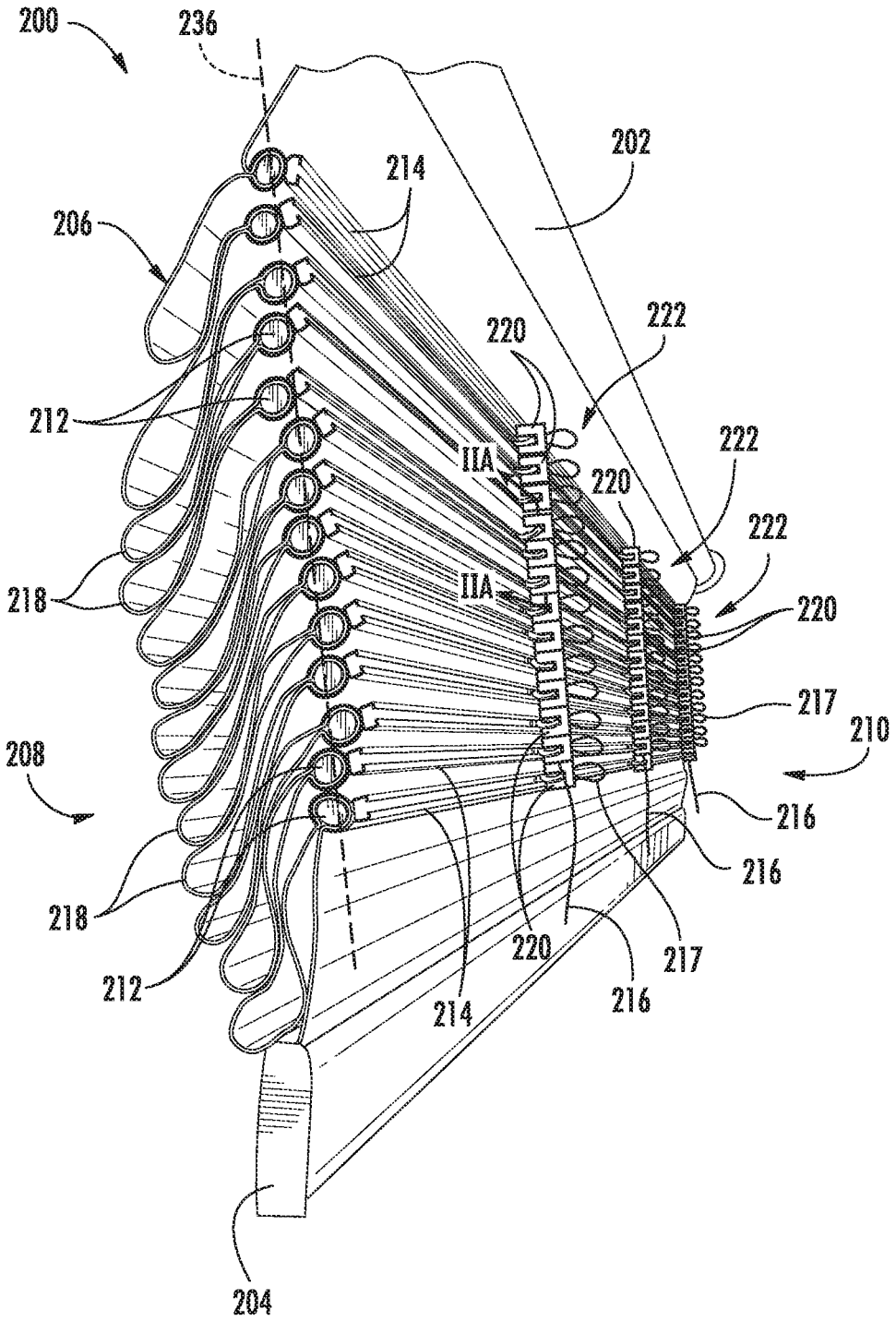
FIG. 2A illustrates a side, perspective view of one illustrative embodiment of a shade assembly in accordance with aspects of the present subject matter, particularly illustrating the shade assembly including batten spacers that form vertical spacer stacks along the back side of the shade fabric when the shade assembly is in its fully opened position.
Figure 2B:
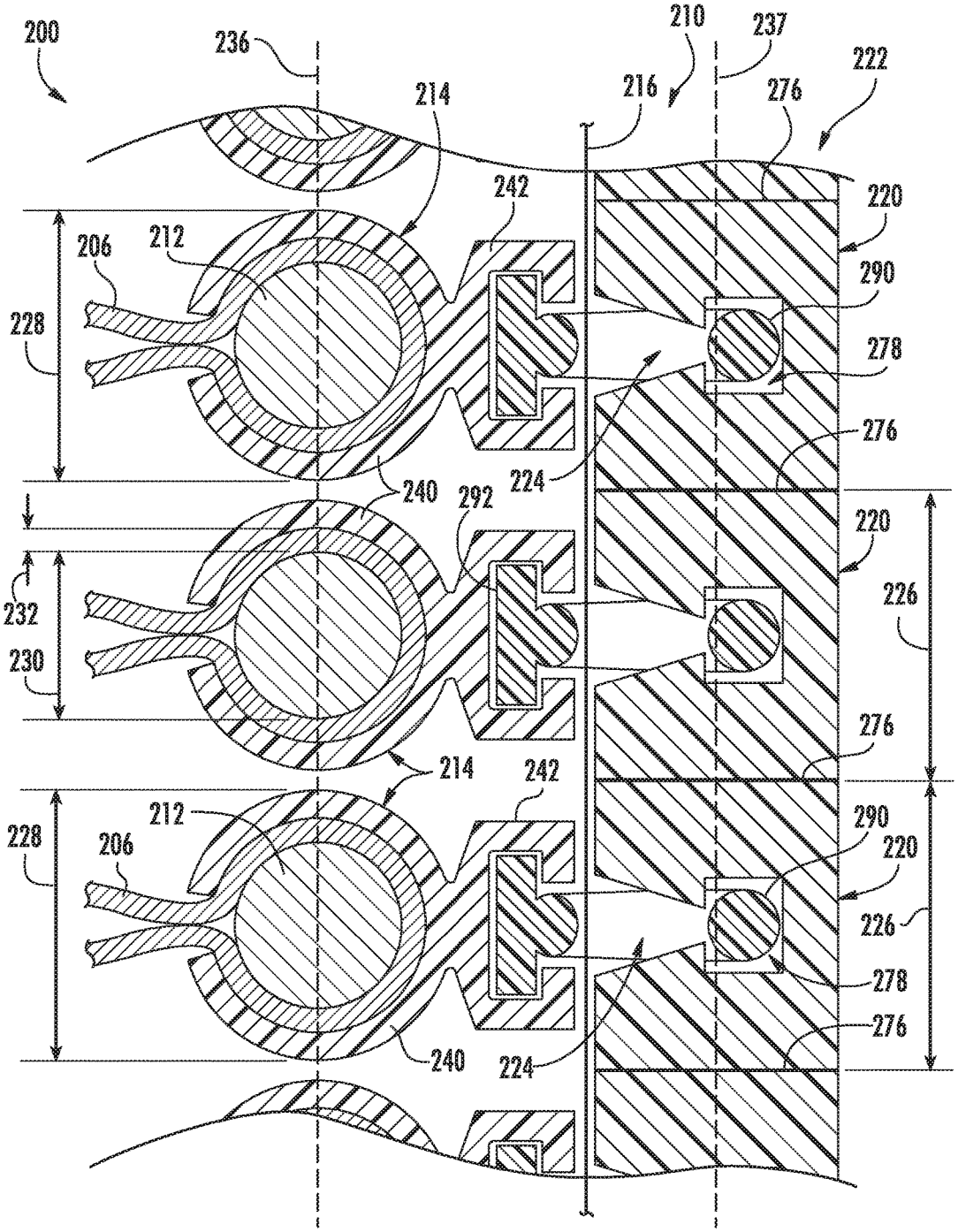
FIG. 2B illustrates a cross-sectional view of a portion of the shade assembly shown in FIG. 2A taken about line IIA-IIA, particularly illustrating the batten spacers stacked vertically end-to-end along the back side of the shade fabric.

Referring now to FIGS. 2A and 2B, one embodiment of a shade assembly 200 configured to be installed relative to an architectural opening is illustrated in accordance with aspects of the present subject matter. Specifically, FIG. 2A illustrates a side, perspective view of shade assembly 200 in a fully opened position. Additionally, FIG. 2B illustrates a cross-sectional view of shade assembly 200 shown in FIG. 2A taken about line IIA-IIA.

As particularly shown in FIG. 2A, an illustrative shade assembly 200 may include a top panel or rail 202, a bottom panel or rail 204, and a shade fabric 206 extending lengthwise between top and bottom rails 202, 204. Shade fabric 206 may generally define a front side 208 and a back side 210 facing opposite front side 208. In one embodiment, front side 208 of shade fabric 206 may be configured to face the interior of the room in which shade assembly 200 is installed while back side 210 of shade fabric 206 may be configured to face the adjacent architectural opening (e.g., a window). Additionally, as is generally understood, shade assembly 200 may be configured to be moved between an opened position (e.g., as shown in FIG. 2A), wherein shade fabric 206 is moved upwards towards to top rail 202 to allow at least a portion of the architectural opening to be exposed to the interior of the room, and an extended or closed position (not shown), wherein portions of shade fabric 206 are moved away from top rail 202 to cover the architectural opening.

Additionally, shade assembly 200 may also include a plurality of battens 212 configured to be coupled to shade fabric 206, with each batten 212 extending lengthwise along the horizontal width of shade fabric 206. Specifically, in several embodiments, battens 212 may be coupled to shade fabric 206 at incrementally spaced locations along the vertical length of fabric 206 such that battens 212 are spaced apart vertically from one another when shade fabric 206 is lowered to move shade assembly 200 to the closed position. As shown in FIGS. 2A and 2B, in one embodiment, each batten 212 may be detachably coupled to shade fabric 206 via a corresponding batten clip 214. Alternatively, battens 212 may be coupled to shade fabric 206 via any other suitable means, such as by sewing battens 212 into shade fabric 206 (e.g., by looping a portion of fabric 206 around each batten 212 and sewing the loop closed) or by securing battens 212 to shade fabric 206 using suitable adhesive(s).

Shade assembly 200 may also include one or more lift cords 216 for raising and lowering shade fabric 206 between the opened and closed positions, respectively. As particularly shown in FIG. 2A, lift cord(s) 216 may be configured to extend vertically along back side 210 of shade fabric 206 between top and bottom rails 202, 204. In one embodiment, lift cord(s) 216 may be fixedly coupled to the bottom batten 212 of shade assembly 200 and may be slidably coupled to the remainder of battens 212. In such an embodiment, as lift cord(s) 216 is pulled upwards or otherwise manipulated to move shade assembly 200 from its closed position to its opened position, the bottom batten 212 may be raised vertically until it engages the next lowest batten 212 (and so on), thereby allowing all of battens 212 to be raised to the closely stacked, vertical arrangement shown in FIG. 2A. Additionally, as shown in FIG. 2A, when shade assembly 200 is at its opened position, shade fabric 206 may form a plurality of folds 218 along its front side 208 as fabric 206 extends lengthwise between adjacent battens 212.

Moreover, in accordance with aspects of the present subject matter, shade assembly 200 may also include a plurality of batten spacers 220 configured to be coupled to battens 212. In several embodiments, batten spacers 220 may be coupled to battens 212 at aligned horizontal locations along the back side 210 of shade fabric 206. As such, when shade assembly 200 is moved to its opened position, batten spacers 220 may form one or more vertically extending columns or stacks 222 (which may be substantially aligned along a plane) along the back side 210 of shade fabric 206. For example, as shown in FIG. 2A, shade assembly 200 includes three vertically extending stacks 222 of batten spacers 220 spaced apart from another along the horizontal width of shade fabric 206. However, in other embodiments, shade assembly 200 may include one or more stacks 222 of batten spacers 220 (e.g., a single stack 222 of batten spacers 220 or a pair of stacks 222 of batten spacers 220) or four or more stacks 222 of batten spacers 220.

In several embodiments, each vertical spacer stack 222 may include one batten spacer 220 for each batten 212, with each batten spacer 220 being coupled to its respective batten 212. As shown in FIG. 2B, in one embodiment, each batten spacer 220 may be coupled to its respective batten 212 via a separate coupling member 224 secured between such batten spacer 220 and the corresponding batten clip 214 being used to attach the respective batten 212 to shade fabric 206. However, in other embodiments, shade assembly 200 may include batten spacers that are configured to be coupled to their respective battens 212 via any other suitable means. Specifically, it will be appreciated that coupling members 224 and/or batten clips 214 need not be present for the batten spacers as disclosed herein to be applied to a shade assembly with battens. For instance, as will be described below with reference to FIGS. 7 and 8, shade assembly 200 may, in one embodiment, include batten spacers configured to be coupled directly to batten clips 212 without the use of intervening coupling members 224. Alternatively, as will be described below with reference to FIG. 9, shade assembly 200 may, in another embodiment, include integrally formed batten clips/spacers such that the disclosed batten spacers may function as both a means for coupling battens 212 to shade fabric 206 and a means for inhibiting battens 212 from becoming distended as shade assembly 200 is moved to the opened position. Similarly, as will be described below with reference to FIG. 10, shade assembly 200 may, in a further embodiment, include batten spacers configured to be directly coupled to battens 212.

It should also be appreciated that, as indicated above, shade fabric 206 may be configured to form folds or overlapped portions along its back side 210 using a means other than battens 212 (e.g., by sewing or adhering shade fabric 206 together to form folds or overlapped portions along its back side 210). With such a shade fabric configuration, one or more embodiments of the disclosed spacers may be utilized in shade assembly 200 without the inclusion of battens 212 as illustrated in the figures. Specifically, in such an embodiment(s), the spacers may be coupled to shade fabric 206 along its back side 210 at the locations of the vertically spaced folds or overlapped portions. As such, when shade assembly 200 is moved to its opened position, the spacers may be configured to vertically engage one another to form a vertical spacer stack or spine along back side 210 of shade fabric 206.

Additionally, as particularly shown in FIG. 2B, each batten spacer 220 may be configured to define an overall vertical dimension or height 226. In several embodiments, the height 226 of each batten spacer 220 may be selected based on an effective stacking height 228 of each batten 212. As indicated above, the effective stacking height 228 of each batten 212 may generally correspond to the vertical dimension that would be defined between adjacent stacking interfaces assuming that battens 212 and any associated components were stacked one on top of another in the vertical direction of shade assembly 200 when such assembly 200 is moved to its opened position. In one embodiment, such vertical dimension may be calculated based on substantial alignment of batten spacers 220 along a vertical plane. For instance, in the embodiment shown in FIG. 2B, the effective stacking height 228 of each batten 212 may correspond to the overall vertical height of each batten clip 214 as installed around its corresponding batten 212 and the portion of shade fabric 206 wrapped around such batten 212. Thus, in such an embodiment, the effective stacking height 228 of each batten 212 may be calculated by summing each of: a diameter or heightwise dimension 230 of batten 212; a collective vertical plane thickness of the portions of shade fabric 206 overlapping or extending around batten 212 in a direction parallel to the vertical plane of shade assembly 200 (e.g., a thickness 232 of shade fabric 206 multiplied by two); and a collective vertical plane thickness of the portions of the associated batten clip 214 overlapping or extending around batten 212 in a direction parallel to the vertical plane of shade assembly 200 (e.g., a summation of a thickness 234 (FIG. 3) of the portions of batten clip 214 that vertically overlap batten 212). However, in embodiments in which the disclosed shade assembly 200 does not include batten clips 214, the effective stacking height 228 may correspond to a different vertical dimension. For instance, as will be described below with reference to FIG. 10, the effective stacking height 228 may simply incorporate the heightwise dimension 230 of each batten 212 along with the collective vertical plane thickness of the portion of shade fabric 206 wrapped around such batten 212 (e.g., for sewn-in battens). Alternatively, the effective stacking height 228 may only incorporate the heightwise dimension 230 of each batten 212 (e.g., for battens 212 adhered to the back side 210 of shade fabric 206 with having portions of fabric 206 vertically overlap each batten 212).

By selecting the height 226 for each batten spacer 220 based on the effective stacking height 228 of each batten 212, it can be ensured that batten spacers 220 vertically engage one another along the back side 210 of shade fabric 206 as shade assembly 200 is moved to its opened position. As such, each vertical spacer stack 222 may form a semi-rigid or rigid "spine" that inhibits battens 212 from collapsing or distending in the manner shown in FIG. 1 (e.g., into the backwards "J-shape."). Rather, as shown in FIG. 2A, when shade assembly 200 is opened, battens 212 may be maintained in a substantially vertical arrangement due to the vertical engagement of batten spacers 220. For example, as particularly shown in FIG. 2B, battens 212 may be substantially aligned along a stacking plane 236 that is spaced apart horizontally from each vertical stack 222 of batten spacers 220 extending along the back side 210 of shade fabric 206.

It should be appreciated that, in one embodiment, stacking plane 236 may be defined from a center of the lowermost or bottom batten 212 of shade assembly 200 to a center of the uppermost or top batten 212 of shade assembly 200. Additionally, in several embodiments, stacking plane 236 may have a substantially vertical orientation. For instance, when shade assembly 200 is moved to its opened position, stacking plane 236 may, in one embodiment, define an angle relative to the vertical direction (e.g., the longitudinal direction of shade fabric 206 when it is moved to its extended position) that is less than 20 degrees, such as less than 15 degrees, or less than 10 degrees, or less than 5 degrees.

It should also be appreciated that the various spacer stacks 222 may also be substantially aligned along a spacer stacking plane 237 that is spaced apart horizontally from stacking plane 236 of battens 212. In one embodiment, spacer stacking plane 237 may be oriented in a substantially vertical direction (e.g., the longitudinal direction of shade fabric 206 when it is moved to its extended position), such as by defining an angle relative to the vertical direction that is less than 20 degrees, such as less than 15 degrees, or less than 10 degrees, or less than 5 degrees. Additionally, in one embodiment, spacer stacking plane 237 may extend substantially parallel to stacking plane 236 of battens 212. Moreover, in one embodiment, each individual spacer stack 222 may be substantially aligned along an axis extending within and/or substantially parallel to the spacer stacking plane 237, such as by being substantially aligned along an axis that is oriented in a substantially vertical direction.

Figure 3:
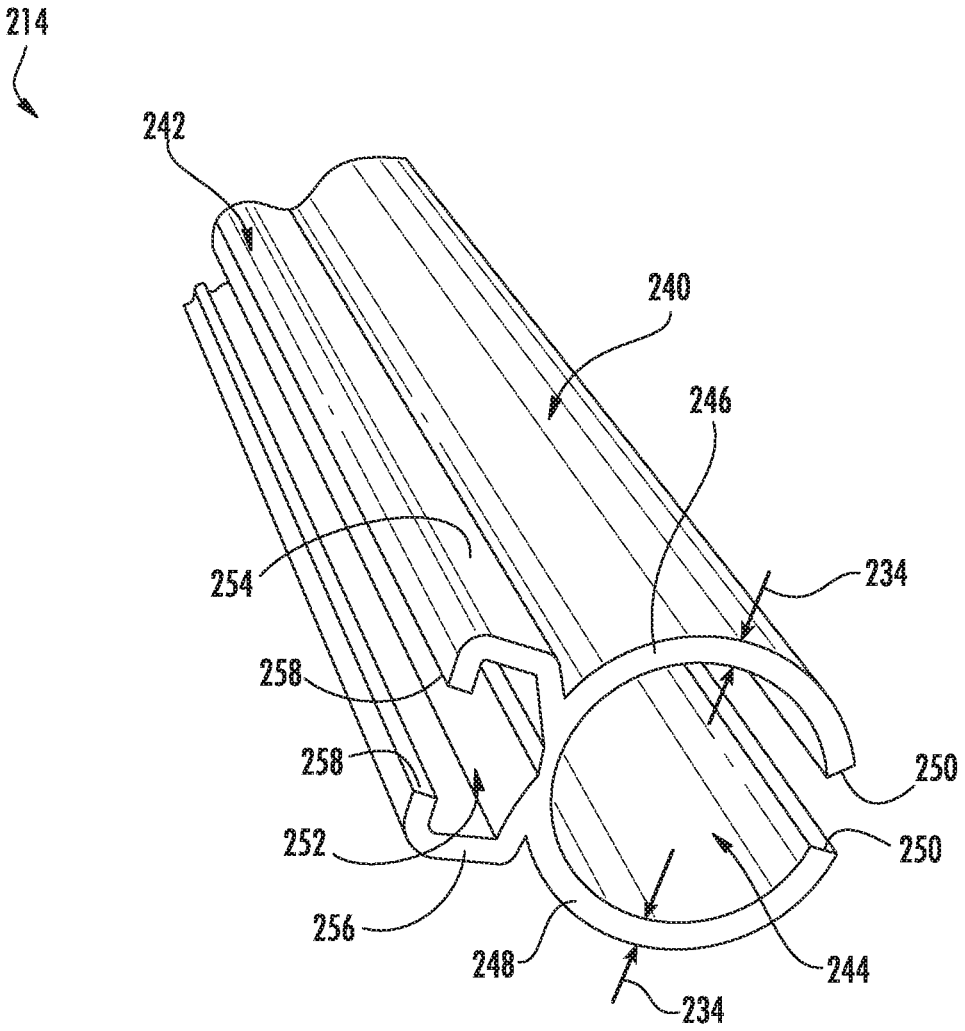
FIG. 3 illustrates a partial, perspective view of one illustrative embodiment of a batten clip that may be included within one or more embodiments of the disclosed shade assembly in accordance with aspects of the present subject matter.

Referring now to FIG. 3, a partial, perspective view of one of the batten clips 214 shown as an example of a batten clip in FIGS. 2A and 2B is illustrated in accordance with aspects of the present subject matter. As shown, batten clip 214 may include both a clip portion 240 and a track portion 242 extending lengthwise along opposed sides or ends of batten clip 214. In general, clip portion 240 may be configured to be "clipped" or otherwise secured to a corresponding batten 212 to allow such batten 212 to be coupled to shade fabric 206 of shade assembly 200. For example, in one embodiment, clip portion 240 may have a "C-shaped" profile defining an open-ended cavity 244 for receiving a corresponding batten 212. Specifically, as shown in FIG. 3, clip portion 240 may include first and second clips arms 246, 248 extending outwardly from track portion 242 along arced or curved paths, with each clip arm 246, 248 terminating at an arm free end 250 that is slightly spaced apart from the opposed free end 250 of the adjacent clip arm 246, 248 so that clip arms 246, 248 collectively define open-ended cavity 244. In such an embodiment, when a batten 212 is positioned at a suitable location along the front side 208 of shade fabric 206, clip portion 240 may be installed along the back side 210 of shade fabric 206 at the location of batten 212 so that batten 212 (and the portion of shade fabric 206 wrapped around such batten 212) is received within open-ended cavity 244 via the gap defined between the adjacent free ends 250 of clip arms 246, 248. Clip portion 240 may then clamp around batten 212, thereby allowing batten 212 to be coupled to shade fabric 206.

As shown in FIG. 3, each clip arm 246, 248 may define a thickness 234 between its outer and inner surfaces. As indicated above, such thickness 234 may, in certain embodiments, be utilized when calculating the effective stacking height 228 of each batten 212. For instance, the thicknesses 234 of clip arms 246, 248 may be summed to define the collective vertical plane thickness associated with batten clip 212, which may, in turn, be summed with the other associated dimensional components (e.g., the heightwise dimension 230 of batten 212 and the collective vertical plane thickness of the portions of shade fabric 206 overlapping or extending around batten 212) to calculate the effective stacking height 228.

Additionally, track portion 242 of batten clip 212 may generally be configured to define an open-ended track 252 along the length of batten clip 212 that extends generally parallel to open-ended cavity 244. For example, as shown in FIG. 3, track portion 242 may include first and second track arms 254, 256 extending outwardly from clip portion 244, with each track arm 254, 256 terminating at a track end 258 that is slightly spaced apart from the opposed end 258 of the adjacent track arm 254, 256 so that track arms 254, 256 collectively define open-ended track 252. As will be described below, track 252 may, in several embodiments, be configured to receive one or more components of the disclosed shade assembly 200, such as one or more coupling members and/or one or more batten spacers.

Referring now to FIGS. 4A-4E, several views of one of the embodiments of batten spacers 220 shown as an example of a batten spacer in FIGS. 2A and 2B are illustrated in accordance with aspects of the present subject matter. Specifically, FIGS. 4A and 4B illustrate differing perspective views of batten spacer 220 while FIG. 4C illustrates a top view of batten spacer 220. Additionally, FIG. 4D illustrates a front view of batten spacer 220 while FIG. 4E illustrates a side view of batten spacer 220.

As shown in the illustrated embodiment, batten spacer 220 may include an upper portion 260, a lower portion 262 spaced apart from upper portion 260, and a connector arm 264 extending between upper and lower portions 260, 262. In one embodiment, upper and lower portions 260, 262, along with connector arm 264, may form a "C-shaped" profile. For example, as shown in FIG. 4E, upper and lower portions 260, 262 may be configured to extend generally perpendicularly from connector arm 264 so that upper and lower portions 260, 262 are oriented generally parallel to each other. Additionally, upper and lower portions 260, 262 may, in one embodiment, each define a semi-circular shape when batten spacer 220 is viewed along its top and bottom sides. For example, as shown in FIG. 4C, each upper and lower portion 260, 262 may include a planar endwall 266 and an arcuate sidewall 268 extending between opposed ends of the planar endwall 266 so as to define a semi-circular shape. Alternatively, upper and lower portions 260, 262 may be configured to define any other suitable shape.

In several embodiments, batten spacer 220 may extend heightwise between a top end 270 defined by upper portion 260 and a bottom end 272 defined by lower portion 262. Additionally, as shown in FIGS. 4A-4E, in one embodiment, top and bottom ends 270, 272 of batten spacer 220 may each have planar profile defining planar stacking surfaces 274. As such, when the disclosed shade assembly 200 is moved to its opened position, adjacent batten spacers 220 may be stacked vertically end-to-end, with their adjacent planar stacking surfaces 274 extending generally parallel to one another. For example, as shown in FIG. 2B, the planar stacking surfaces 274 of adjacent batten spacers 220 may be seated substantially flush against one another such that a planar stacking interface 276 is defined between each pair of adjacent batten spacers 212.

Referring back to FIGS. 4A-4E, due to the vertical spacing between upper and lower portions, batten spacer may also define an interior space or channel 278. For example, as shown particularly in FIG. 4D, channel 278 may be defined vertically between a bottom surface 280 of upper portion 260 and a top surface 282 of lower portion 262. Additionally, as shown in FIG. 4E, channel 278 may extend horizontally between a forward end (not referenced in FIG. 4E) aligned with endwalls 266 of upper and lower portions 260, 262 and an aft end (not referenced in FIG. 4E) defined by connector arm 264.

As will be described in greater detail below, channel 278 may, in several embodiments, be configured to receive a portion (e.g., in the illustrated example, an annular portion) of a corresponding coupling member 224 (FIG. 2B) that is being utilized to couple batten spacer 220 to a given batten 212 via its associated batten clip 214. In such embodiments, batten spacer 220 may also include suitable retention features for securing such coupling member 224 to batten spacer 220. For instance, in one embodiment, batten spacer 220 may include upper and lower retention lips 284, 286 extending inwardly into channel 278 from upper and lower portions 260, 262, respectively. As shown in FIG. 4E, upper and lower retention lips 284, 286 may be inclined in the direction of the aft end of channel 278 (e.g., in the direction of connector arm 264). Thus, when the corresponding portion of a suitable coupling member 224 is pushed between upper and lower retention lips 284, 286 towards the aft end of channel 278, the portion may snap behind upper and lower retention lips 284, 286 and be retained within channel 278 between retention lips 284, 286 and connector arm 264, thereby providing a secure connection between batten spacer 220 and the associated coupling member 224. However, it should be appreciated that, in other embodiments, batten spacer 220 may include any other suitable retention features that may allow a coupling member 224 or other suitable component to be coupled to batten spacer 220.

Additionally, as shown in FIG. 4E, one or more sections of each sidewall 268 of batten spacer 220 may, in one embodiment, be recessed relative to the remainder of such sidewall 268 to form one or more recessed cavities or hollow sections 288 along the sides of upper and lower portions 260, 262. Alternatively, sidewalls 268 may, instead, be configured to define a continuous or flat profile without forming any hollow section(s).

It should be appreciated that the embodiment of batten spacer 220 shown in FIGS. 4A-4E is simply illustrated to provide one example of a suitable spacer configuration that may be utilized in association with the disclosed shade assembly 200 in accordance with aspects of the present subject matter. Thus, one of ordinary skill in the art should readily understand that any number of modifications or alterations may be made to the configuration of batten spacer 220 shown in FIGS. 4A-4E while remaining within the scope of the present subject matter. For example, batten spacer 220 may be configured to define any other suitable shape that allows such spacer 220 to generally function as described herein.

Figure 5:
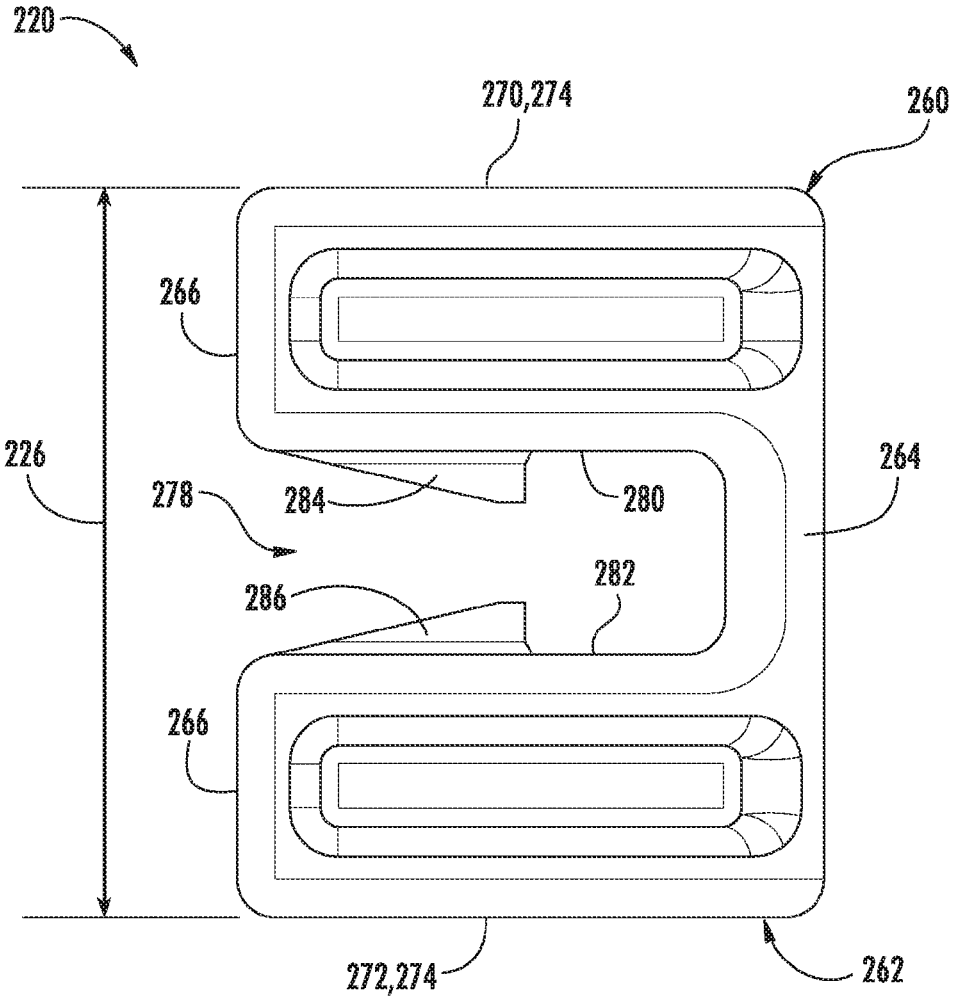
FIG. 5 illustrates another side view of the embodiment of the batten clip shown in FIGS. 4A-4E.

Referring now to FIG. 5, another side view of batten spacer 220 described above with reference to FIGS. 4A-4E is illustrated in accordance with aspects of the present subject matter. As shown in FIG. 5, batten spacer 220 may be configured to define a height 226 between its top and bottom ends 270, 272. As indicated above, the height 226 of each batten spacer 220 may, in several embodiments, be selected based on the effective stacking height 228 of battens 212. Specifically, in accordance with aspects of the present subject matter, height 226 may be selected such that ends 270, 272 of adjacent batten spacers 220 contact or otherwise engage one another as battens 212 are being raised to move shade assembly 200 to its opened position, thereby allowing batten spacers 220 to stack-up vertically end-to-end to form one or more vertical "spines" or stacks 222 along the back side 210 of shade fabric 206.

For example, in several embodiments, the height 226 of each batten spacer 220 may be selected to be substantially equal to the effective stacking height 228 (FIG. 2B) of each batten 212. In one embodiment, the height 226 of each batten spacer 220 may be considered to be substantially equal to the effective stacking height 228 if height 226 falls with +/−10% of the effective stacking height 228, such as a height that falls within +/−5% of the effective stacking height 228, or a height that falls within +/−2% of the effective stacking height 228, or a height that falls within +/−1% of the effective stacking height 228. In another embodiment, the height 228 of each batten spacer 220 may be selected to be greater than the effective stacking height 228 of each batten 212, such as by configuring the height 226 of each batten spacer 220 to be at least 1% greater than the effective stacking height 228, or at least 2% greater than the effective stacking height 228, or at least 5% greater than the effective stacking height 228, or at least 10% greater than the effective stacking height 228.

It should be appreciated that the effective stacking height 228 may generally vary depending on numerous factors, including the heightwise dimension 230 of each batten 212 and the specific configuration of shade assembly 200 (e.g., the manner in which battens 212 are coupled to shade fabric 206). However, in a particular embodiment, the effective stacking height 228 may generally be equal to greater than 0.06 inches and/or less than 1.00 inches, such as greater than 0.10 inches and/or less than 0.90 inches, or greater than 0.25 inches and/or less than 0.75 inches.

Figure 6:
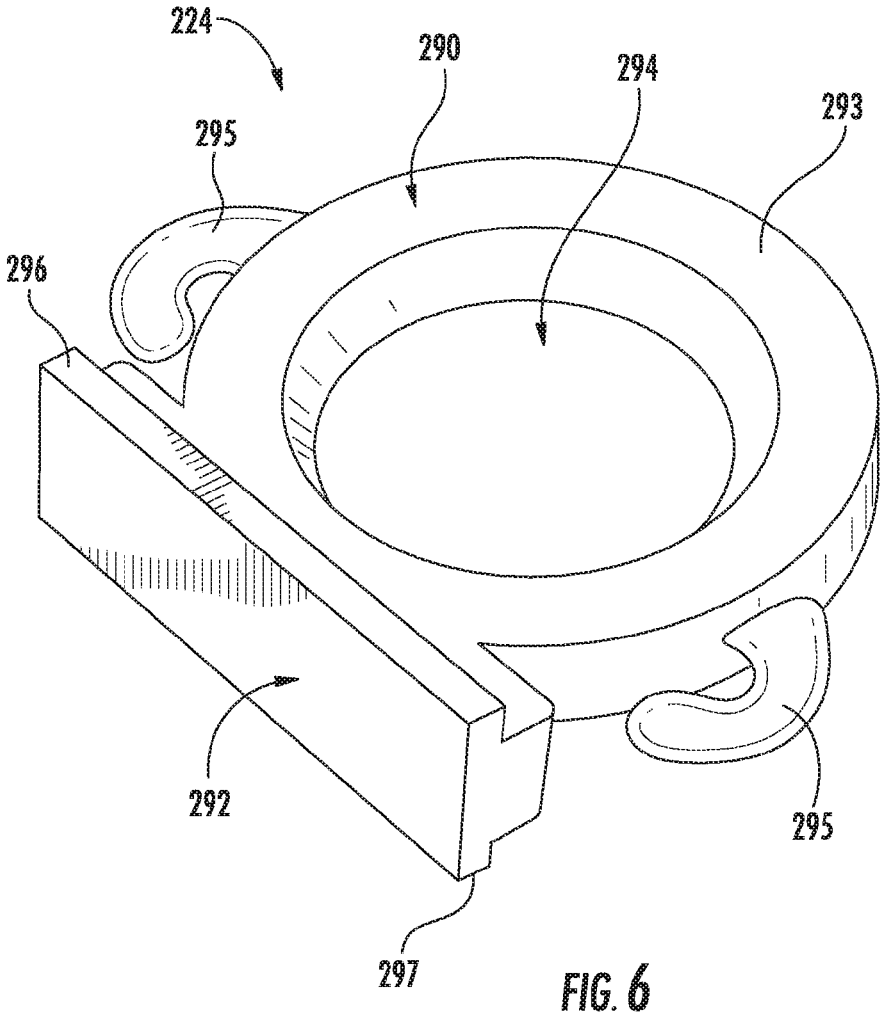
FIG. 6 illustrates a perspective view of one illustrative embodiment of a coupling member that may be included within one or more embodiments of the disclosed shade assembly in accordance with aspects of the present subject matter.

Referring now to FIG. 6, a perspective view of one of the coupling members 224 shown as an example of a coupling member in FIGS. 2A and 2B is illustrated in accordance with aspects of the present subject matter. As shown in FIG. 6, coupling member 224 may include both an annular-shaped, spacer-engaging portion 290 and a clip-engaging portion 292 extending outwardly from spacer-engaging portion 290. In general, spacer-engaging portion 290 may be configured to be received within channel 278 (FIGS. 4A-4E) defined by batten spacer 220. For example, spacer-engaging portion 290 may configured to be inserted between upper and lower portions 260, 262 of batten spacer 220 such that a forward end 293 of spacer-engaging portion 290 is retained horizontally between upper and lower retention lips 284, 286 and connector arm 264 of batten spacer 220.

In addition, spacer-engaging portion 290 may also define an opening 294 extending therethrough, thereby serving a dual function. In several embodiments, one or more cords of shade assembly 200 may be configured to extend through opening 290. For example, in one embodiment, one or more of the lift cords 216 may be routed through opening 290. In such an embodiment, as shown in FIG. 2B, lift cord(s) 216 may be configured to extend vertically along the back side 210 of shade fabric 210 through the aligned openings 294 of adjacent coupling members 224 at a location defined between each corresponding pair of batten clips/spacers 214, 220. In addition to lift cord(s) 216 or as an alternative thereto, one or more shroud or safety cords 217 (FIG. 2A) of shade assembly 200 may be received within opening 290, which may provide a safety feature to inhibit unintended extension of lift cord(s) 216.

Referring back to FIG. 6, in one embodiment, coupling member 224 may also include one or more additional features for coupling one or more other cords of shade assembly 200 to coupling member 224. For example, as shown in FIG. 6, coupling member 224 may include one or more hooked projections 295 extending outwardly from spacer-engaging portion 290 that are configured to receive one or more suitable cords, such as one or more shroud or safety cords 217 (FIG. 2A) of shade assembly 200.

Additionally, clip-engaging portion 292 of coupling member 224 may generally be configured to be coupled to a corresponding batten clip 214 of shade assembly 200. Specifically, in several embodiments, clip-engaging portion 292 may be configured to be received within the track 252 defined by each batten clip 214. For example, as shown in FIG. 6, clip-engaging portion 292 may include first and second flanges 296, 297 extending outwardly relative to the opposed sides of spacer-engaging portion 290. In such an embodiment, when clip-engaging portion 292 is received within track 252 of batten clip 214, first and second flanges 296, 297 may be engaged against or otherwise contact first and second track arms 254, 256 of batten clip 214, thereby allowing coupling member 224 to be coupled to batten clip 214.

Referring back to FIG. 2B, based on the configuration of the various shade assembly components described above, each batten spacer 220 may, in certain embodiments, be coupled to a corresponding batten 212 via the connection provided by each coupling member 224 and the associated batten clip 214. For example, as shown in FIG. 2B, each batten spacer 220 may be directly coupled to one of the coupling members 224 (e.g., via the connection between spacer-engaging portion 290 and batten spacer 220), which is, in turn, directly coupled to an associated batten clip 214 (e.g., via the connection between clip-engaging portion 292 and track 252) used to couple the corresponding batten 212 to shade fabric 206. Thus, as shade assembly 200 is being moved to its opened position (e.g., as shown in FIG. 2B), the batten spacer(s) 220 coupled to the lowermost batten 212 of shade assembly 200 may be configured to contact or otherwise vertically engage the batten spacer(s) 220 coupled to the batten 212 positioned directly above the lowermost batten 212. As battens 212 continue to be raised upward to the fully opened position, their respective batten spacers 220 may the stack-up along the back side 210 of the shade fabric 206 to form the vertical spacer stacks 222 or spines described above, thereby maintaining the battens 212 generally aligned with their stacking plane 236 (e.g., a substantially vertical stacking plane).

Figure 7:
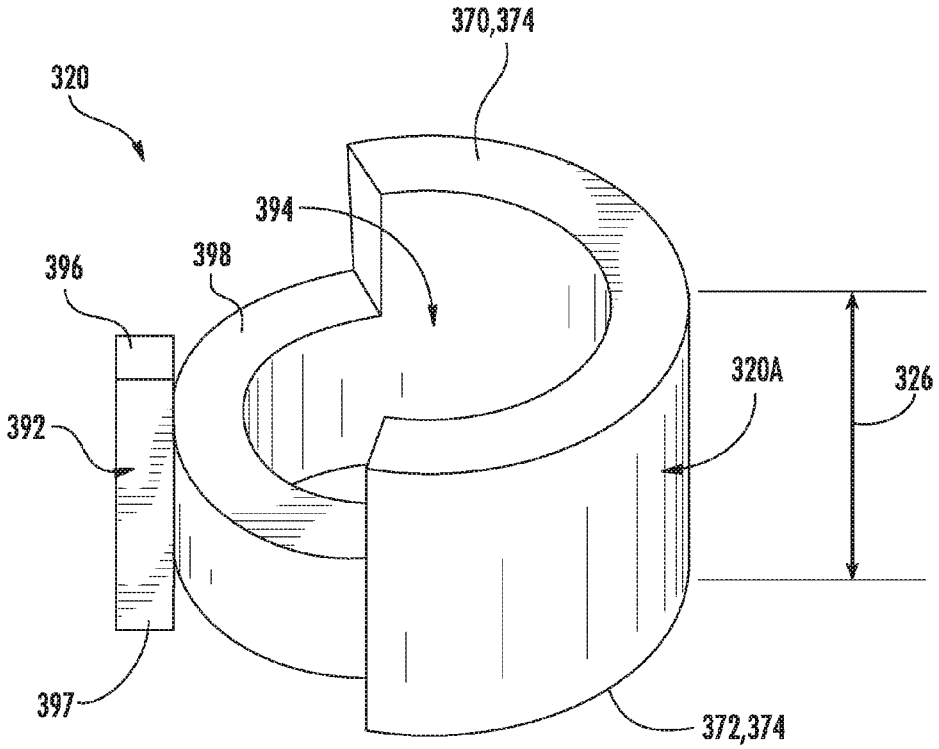
FIG. 7 illustrates a perspective view of another illustrative embodiment of a batten spacer that may be included within one or more embodiments of the disclosed shade assembly in accordance with aspects of the present subject matter.

Referring now to FIG. 7, a perspective view of another embodiment of a batten spacer 320 that may be utilized with shade assembly 200 described above with reference to FIGS. 2A and 2B as an alternative to batten spacer 220 and its associated coupling member 224 is illustrated in accordance with aspects of the present subject matter. It should be appreciated that, in the following description of FIG. 7, any elements, features, and/or components similar to those shown in the embodiment of FIGS. 2A-6 (including FIG. 2B and FIGS. 4A-4E) have been designated with the same reference numbers increased by 100 and redundant description has been omitted.

As shown, unlike the embodiment described above, batten spacer 320 may be configured to be coupled directly to a batten clip 214 of shade assembly 200, thereby eliminating the need for a separate coupling member 224. In such an embodiment, batten spacer 320 may generally be configured to incorporate one or more elements, features, and/or components of the batten spacers 220 and coupling members 224 described above. For instance, as shown in FIG. 7, batten spacer 320 may include both a spacer portion 320A and a clip-engaging portion 392 extending outwardly from spacer portion 320A. In general, spacer portion 320A may be configured to function similar to aspects of each batten spacer 220 described above. For example, spacer portion 320A may be configured to extend heightwise between a top end 370 and a bottom end 372. As shown in FIG. 7, in one embodiment, top and bottom ends 370, 372 may each have a planar profile defining a planar stacking surface 374.

Additionally, spacer portion 320A may also define height 326 extending between its top and bottom ends 370, 372. Similar to the embodiment described above, the height 326 of spacer portion 320A may generally be selected based on the effective stacking height 228 (FIG. 2B) of the battens 212 of shade assembly 200. As such, when batten spacers 320 are installed within shade assembly 200 and such assembly 200 is moved to its opened position, adjacent spacer portions 320A may be configured to vertically engage one another end-to-end (e.g., by creating planar stacking interfaces between adjacent spacer portions 320A) along the back side 210 of shade fabric 206 to form a semi-rigid or rigid vertical spacer stack that inhibits the associated battens 212 from becoming distended in the manner shown in FIG. 1. Rather, due to the vertical engagement of spacer portions 320A, battens 212 may be maintained in a substantially vertical arrangement when the shade assembly 200 is moved to its opened position, such as by maintaining battens 212 substantially aligned along stacking plane 236.

Moreover, in several embodiments, spacer portion 320A may define an opening 394 extending heightwise through spacer portion 320A. For example, as shown in FIG. 7, spacer portion 320A may have an annular or cylindrical configuration such that opening 394 is defined through spacer portion 320A between its top and bottom ends 370, 372. In such an embodiment, opening 394 may be configured to receive one or more cords of shade assembly 200, such as by routing one or more lift cords 216 and/or one or more safety cords 217 through opening 394.

Referring still to FIG. 7, clip-engaging portion 392 of batten spacer 320 may generally be configured similar to clip-engaging portion 292 of coupling member 224 described above. Specifically, in several embodiments, clip-engaging portion 392 may be configured to be received within track 252 defined by an associated batten clip 214. For instance, clip-engaging portion 392 may include first and second flanges 396, 397 extending from a recessed section 398 of spacer portion 320A that are configured to be engaged with corresponding track arms 254, 256 of batten clip 214. As such, by inserting clip-engaging portion 392 within track 252, batten spacer 320 may be coupled directly to one of the batten clips 214.

Figure 8:
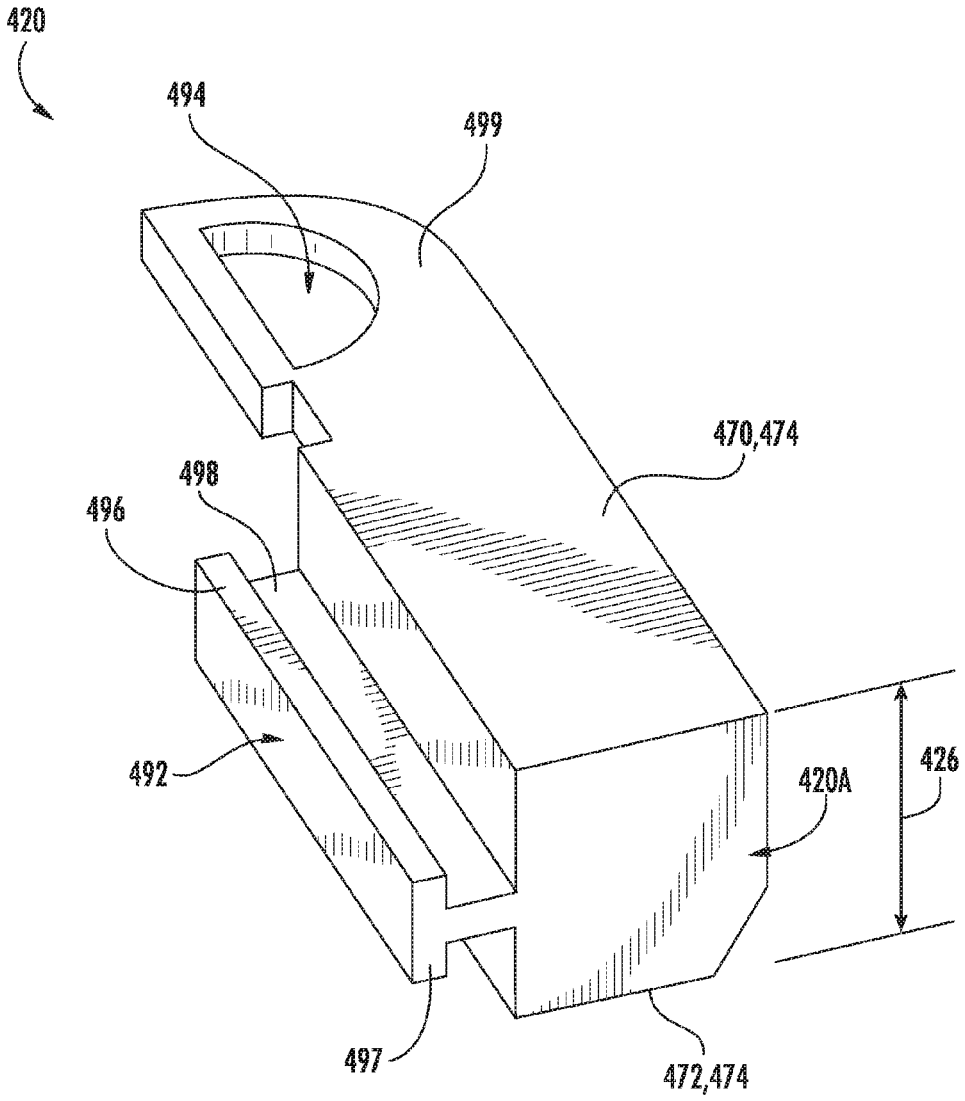
FIG. 8 illustrates a perspective view of a further illustrative embodiment of a batten spacer that may be included within one or more embodiments of the disclosed shade assembly in accordance with aspects of the present subject matter.

Referring now to FIG. 8, a perspective view of a further embodiment of a batten spacer 420 that may be utilized with shade assembly 200 described above with reference to FIGS. 2A and 2B as an alternative to batten spacer 220 and its associated coupling member 224 is illustrated in accordance with aspects of the present subject matter. It should be appreciated that, in the following description of FIG. 8, any elements, features, and/or components similar to those shown in the embodiments of FIGS. 2A-7 (including FIG. 2B and FIGS. 4A-4E) have been designated with the same reference numbers increased by 100 (or a multiple of 100) and redundant description has been omitted.

As shown, similar to the embodiment described above with reference to FIG. 7, batten spacer 420 may be configured to be coupled directly to a batten clip 214 of shade assembly 200, thereby removing the need for a separate coupling member 224. In such an embodiment, batten spacer 420 may generally be configured to incorporate one or more elements, features, and/or components of the batten spacers 220, 320 and/or coupling members 224 described above. For instance, as shown in FIG. 8, batten spacer 420 may include both a spacer portion 420A and a clip-engaging portion 492 extending outwardly from spacer portion 420A. In general, spacer portion 420A may be configured to function similar to aspects of each batten spacer 220 and/or spacer portion 320A described above. For example, spacer portion 420A may be configured to extend heightwise between a top end 470 and a bottom end 472. As shown in FIG. 8, in one embodiment, top and bottom ends 470, 472 may each have a planar profile defining a planar stacking surface 474.

Additionally, spacer portion 420A may also define height 426 extending between its top and bottom ends 470, 472. Similar to the embodiments described above, the height 426 of spacer portion 420A may generally be selected based on the effective stacking height 228 (FIG. 2B) of the battens 212 of shade assembly 200. As such, when batten spacers 420 are installed within shade assembly 200 and such assembly 200 is moved to its opened position, adjacent spacer portions 420A may be configured to vertically engage one another end-to-end (e.g., by creating planar stacking interfaces between adjacent spacer portions 420A) along the back side 210 of shade fabric 206 to form a semi-rigid or rigid vertical spacer stack that inhibits the associated battens 212 from becoming distended in the manner shown in FIG. 1. Rather, due to the vertical engagement of spacer portions 420A, battens 212 may be maintained in a substantially vertical arrangement when the shade assembly 200 is moved to its opened position, such as by maintaining battens 212 substantially aligned along stacking plane 236.

Additionally, clip-engaging portion 492 of batten spacer 420 may generally be configured similar to clip-engaging portion 292, 392 described above. Specifically, in several embodiments, clip-engaging portion 492 may be configured to be received within track 252 defined by an associated batten clip 214. For instance, clip-engaging portion 492 may include first and second flanges 496, 497 extending from a recessed section 498 of spacer portion 420A that are configured to be engaged with corresponding track arms 254, 256 of batten clip 214. As such, by inserting clip-engaging portion 492 within track 252, batten spacer 420 may be coupled directly to one of the batten clips 214.

Moreover, as shown in FIG. 8, in one embodiment, batten spacer 420 may also include a lateral extension 499 extending outwardly from spacer portion 420A that defines an opening 494 therethrough. In such an embodiment, opening 494 may be configured to receive one or more cords of shade assembly 200, such as by routing one or more lift cords 216 and/or one or more safety cords 217 through opening 494.

Figure 9:
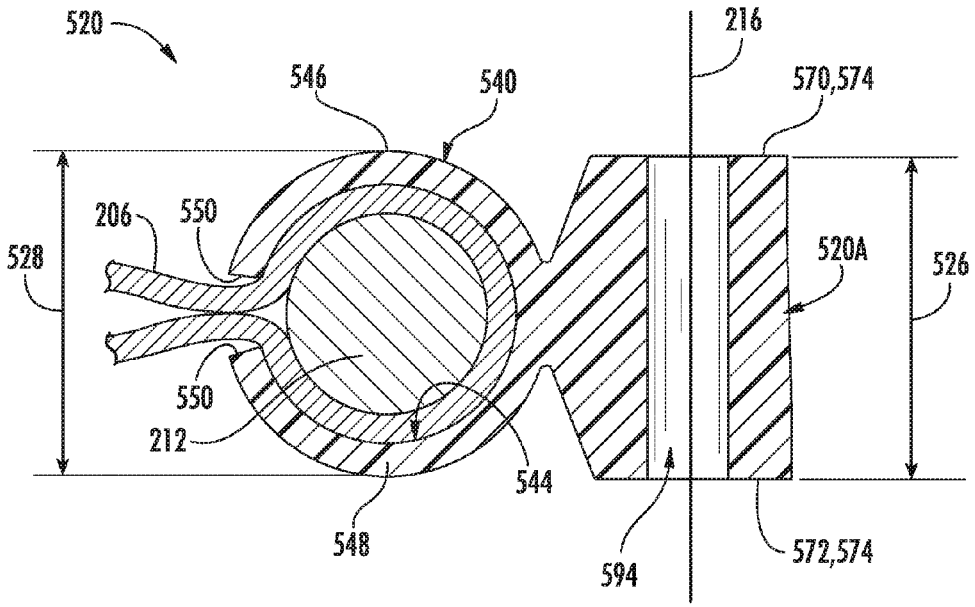
FIG. 9 illustrates a cross-sectional view of yet another illustrative embodiment of a batten spacer that may be included within one or more embodiments of the disclosed shade assembly in accordance with aspects of the present subject matter, particularly illustrating the batten spacer wrapped around a portion of a batten of the disclosed shade assembly.

Referring now to FIG. 9, a perspective view of a further embodiment of a batten spacer 520 that may be utilized with shade assembly 200 described above with reference to FIGS. 2A and 2B as an alternative to batten spacer 220, its associated coupling member 224, and the corresponding batten clip 214 is illustrated in accordance with aspects of the present subject matter. It should be appreciated that, in the following description of FIG. 9, any elements, features, and/or components similar to those shown in the embodiments of FIGS. 2A-8 (including FIG. 2B and FIGS. 4A-4E) have been designated with the same reference numbers increased by 100 (or a multiple of 100) and redundant description has been omitted.

As shown, unlike the embodiments described above, batten spacer 520 may be configured to incorporate one or more elements, features, and/or components of the batten spacers 220, 320, 420 and batten clips 212 described above. By incorporating aspects of batten clip 212 into batten spacer 520, the functionality of both a batten spacer and a batten clip (as described herein) may be integrated into a single component, thereby eliminating the need for one or more separate components (e.g., a separate coupling member 224 and/or a separate batten spacer 220, 320, 430) to be coupled to a separate batten clip 212.

As shown in FIG. 9, batten spacer 520 may include both a spacer portion 520A and a clip portion 540. In general, spacer portion 520A may be configured to function similar to aspects of each batten spacer 220 and/or spacer portion 320A, 420A described above. For example, spacer portion 520A may be configured to extend heightwise between a top end 570 and a bottom end 572. As shown in FIG. 7, in one embodiment, top and bottom ends 570, 572 may each have a planar profile defining a planar stacking surface 574.

Spacer portion 520A may also define height 526 extending between its top and bottom ends 570, 572. Similar to the embodiments described above, the height 526 of spacer portion 520A may generally be selected based on the effective stacking height 528 of battens 212 of shade assembly 200, which, in the illustrated embodiment, may generally correspond to the vertical height of clip portion 540 of batten spacer 520. As such, when batten spacers 520 are installed within shade assembly 200 and such assembly 200 is moved to its opened position, adjacent spacer portions 520A may be configured to vertically engage one another end-to-end (e.g., by creating planar stacking interfaces between adjacent spacer portions 520A) along the back side 210 of shade fabric 206 to form a semi-rigid or rigid vertical spacer stack that inhibits the associated battens 212 from becoming distended in the manner shown in FIG. 1. Rather, due to the vertical engagement of spacer portions 520A, battens 212 may be maintained in a substantially vertical arrangement when the shade assembly 200 is moved to its opened position, such as by maintaining battens 212 substantially aligned along stacking plane 236.

Moreover, in several embodiments, spacer portion 520A may define an opening 594 extending heightwise through spacer portion 520A. For example, as shown in FIG. 9, opening 594 may be defined through spacer portion 520A between its top and bottom ends 570, 572. In such an embodiment, opening 594 may be configured to receive one or more cords of shade assembly 200, such as by routing one or more lift cords 216 and/or one or more safety cords 217 through opening 594.

Referring still to FIG. 9, clip portion 540 of batten spacer 520A may generally be configured similar to clip portion 240 of each batten clip 212 described above. For example, clip portion 540 may include first and second clips arms 546, 548 extending outwardly from spacer portion 520A along arced or curved paths, with each clip arm 546, 548 terminating at an arm end 550 that is slightly spaced apart from the opposed end 550 of the adjacent clip arm 546, 548 so that clip arms 546, 548 collectively define an open-ended cavity 544. In such an embodiment, when a batten 212 is positioned at a suitable location along the front side 208 of shade fabric 206, clip portion 540 may be installed along the back side 210 of shade fabric 206 at the location of batten 212 so that batten 212 (and the portion of shade fabric 206 wrapped around such batten 212) is received within open-ended cavity 544 via the gap defined between the adjacent ends 550 of clip arms 546, 548. Clip portion 540 may then clamp around batten 512, thereby allowing batten 212 to be coupled to shade fabric 206.

It should be appreciated that, in one embodiment, spacer portion 520A may be configured to extend lengthwise along the entire length of clip portion 540 (e.g., across the entire width of shade fabric 206). Alternatively, batten spacer 520 may include one or more discrete spacer portions 520A positioned along the length of clip portion 540. For example, in the embodiment of shade assembly 200 shown in FIG. 2A, batten spacer 520 may include three discrete spacer portions 520A spaced apart along the length of clip portion 540 so that such spacer portions 520A may be horizontally aligned with the spacer portions 520A of adjacent batten spacers 520, thereby allowing three separate vertical spacer stacks to be formed along the back side 210 of shade fabric 206.

Figure 10:
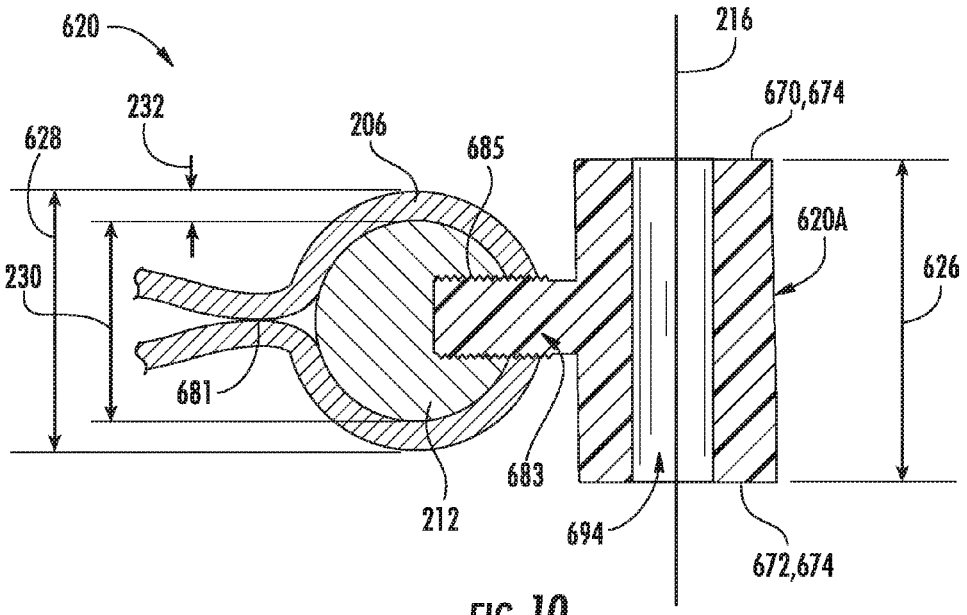
FIG. 10 illustrates a cross-sectional view of an even further illustrative embodiment of a batten spacer that may be included within one or more embodiments of the disclosed shade assembly in accordance with aspects of the present subject matter, particularly illustrating the batten spacer coupled directly to a batten of the disclosed shade assembly.

Referring now to FIG. 10, a perspective view of a yet another embodiment of a batten spacer 620 that may be utilized with shade assembly 200 described above with reference to FIGS. 2A and 2B as an alternative to batten spacer 220, its associated coupling member 224, and the corresponding batten clip 214 is illustrated in accordance with aspects of the present subject matter. It should be appreciated that, in the following description of FIG. 10, any elements, features, and/or components similar to those shown in the embodiments of FIGS. 2A-9 (including FIG. 2B and FIGS. 4A-4E) have been designated with the same reference numbers increased by 100 (or a multiple of 100) and redundant description has been omitted.

As shown, unlike the embodiments described above, batten spacer 620 is configured for use with battens 212 that are configured to be coupled to shade fabric 206 without batten clips 212. Specifically, as shown in FIG. 10, batten 212 may be sewn-into shade fabric 206, such as by looping a portion of shade fabric 206 around batten 212 and sewing the loop closed (e.g., at fabric attachment location 681). In such an embodiment, batten spacer 620 may be configured to be directly coupled to batten 212, thereby eliminating the need for one or more separate components (e.g., a separate coupling member 224 and/or a separate batten spacer 220, 320, 430) to be coupled to a separate batten clip 212.

As shown in FIG. 10, batten spacer 620 may include both a spacer portion 620A and an attachment portion 683 extending outwardly from spacer portion 620A. In general, spacer portion 620A may be configured to function similar to each batten spacer 220 and/or spacer portion 320A, 420A, 520A described above. For example, spacer portion 620A may be configured to extend heightwise between a top end 670 and a bottom end 672. As shown in FIG. 10, in one embodiment, top and bottom ends 670, 672 may each have a planar profile defining a planar stacking surface 674.

Spacer portion 620A may also define height 626 extending between its top and bottom ends 670, 672. Similar to the embodiments described above, the height 626 of spacer portion 620A may generally be selected based on the effective stacking height 628 of battens 212 of shade assembly 200, which, in the illustrated embodiment, may generally correspond to the vertical height defined by the summation of the heightwise dimension 230 of batten 212 and the collective vertical plane thickness of the portions of shade fabric 206 overlapping or extending around batten 212 in a direction parallel to the vertical plane of shade assembly 200 (e.g., a thickness 232 of shade fabric 206 multiplied by two). As such, when batten spacers 620 are installed within shade assembly 200 and such assembly 200 is moved to its opened position, adjacent spacer portions 620A may be configured to vertically engage one another end-to-end (e.g., by creating planar stacking interfaces between adjacent spacer portions 620A) along the back side 210 of shade fabric 206 to form a semi-rigid or rigid vertical spacer stack that inhibits the associated battens 212 from becoming distended in the manner shown in FIG. 1. Rather, due to the vertical engagement of spacer portions 620A, battens 212 may be maintained in a substantially vertical arrangement when the shade assembly 200 is moved to its opened position, such as by maintaining battens 212 substantially aligned along stacking plane 236.

Moreover, in several embodiments, spacer portion 620A may define an opening 694 extending heightwise through spacer portion 620A. For example, as shown in FIG. 10, opening 694 may be defined through spacer portion 620A between its top and bottom ends 670, 672. In such an embodiment, opening 694 may be configured to receive one or more cords of shade assembly 200, such as by routing one or more lift cords 216 and/or one or more safety cords 217 through opening 694.

Referring still to FIG. 10, attachment portion 683 of batten spacer 620 may generally correspond to any suitable feature or element that allows batten spacer 620 to be coupled to batten 212. For instance, in the illustrated embodiment, attachment portion 683 defines a threaded end 685 configured to be received within a corresponding threaded opening (not shown) defined by batten 212. In such an embodiment, batten spacer 620 may be punctured through shade fabric 206 and screwed into the threaded opening to allow spacer 620 to be coupled to batten 212. Alternatively, attachment portion 683 may have any other suitable configuration that allows batten spacer 620 to be coupled to batten 212, such as without requiring a particular orientation of batten spacer 620 with respect to batten 212 or without the use of threaded coupling.

It should be appreciated that the various batten spacers 220, 320, 420, 520, 620 described herein may generally be formed from any suitable material. However, in one embodiment, batten spacers 220, 320, 430, 520, 620 may be formed from a relatively lightweight, substantially rigid material, such as a plastic material.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A shade assembly, comprising:

a shade fabric having a front side and a back side;

a lift cord positioned along said back side of said shade fabric;

two or more spacers, each of said spacers being coupled to said shade fabric at spaced apart locations along a vertical length of said shade fabric, said spacers being substantially aligned with one another horizontally along said back side of said shade fabric; and wherein:

when said shade fabric is moved to an opened position, said spacers are configured to engage one another to form a vertical spacer stack along said back side of said shade fabric that maintains at least a portion of said shade fabric in a substantially vertical arrangement; and said lift cord extends vertically past said spacers outside of said vertical spacer stack formed by said spacers at a location between said back side of said shade fabric and said vertical spacer stack when said shade fabric is moved to the opened position.

2. A shade assembly as in claim 1, wherein each of said spacers defines at least one planar surface, said at least one planar surface being configured to contact a corresponding planar surface of at least one adjacent spacer of said shade assembly when said shade fabric is moved to the opened position.

3. A shade assembly as in claim 2, wherein a planar stacking interface is defined between said at least one planar surface and said corresponding planar surface when said shade fabric is moved to the opened position.

4. A shade assembly as in claim 1, further comprising two or more battens coupled to said shade fabric at said spaced apart locations, each of said spacers being coupled to a respective one of said battens, said vertical spacer stack being configured to maintain said battens in a substantially vertical arrangement relative to one another when said shade fabric is moved to the opened position.

5. A shade assembly as in claim 4, wherein each of said spacers extends heightwise between a top end and a bottom end and defines a height between said top and bottom ends, said height being substantially equal to or greater than an effective stacking height of each of said battens.

6. A shade assembly as in claim 4, wherein, when said shade fabric is moved to the opened position, said spacers are spaced apart from said battens in a direction perpendicular to a stacking plane associated with said battens.

7. A shade assembly as in claim 4, further comprising two or more batten clips, each of said spacers being coupled to said respective one of said battens via a respective one of said batten clips.

8. A shade assembly as in claim 7, wherein each of said batten clips includes a clip portion and a track portion, said clip portion being configured to couple one of said battens to said shade fabric, said track portion defining an open-ended track.

9. A shade assembly as in claim 7, further comprising two or more coupling members, each of said spacers being coupled to said respective one of said batten clips via a respective one of said coupling members.

10. A shade assembly as in claim 9, wherein each of said coupling members includes a spacer-engaging portion configured to be coupled to one of said spacers and a clip-engaging portion configured to be received within a track defined by each of said batten clips.

11. A shade assembly as in claim 10, wherein each of said spacers includes an upper portion and a lower portion, said lower portion being spaced apart from said upper portion such that a channel is defined between said upper and lower portions, said spacer-engaging portion being configured to be received within said channel.

12. A shade assembly as in claim 11, wherein each of said spacers further includes a connector arm extending between said upper and lower portions, said spacer-engaging portion being configured to be received within said channel such that said spacer-engaging portion is maintained between said connector arm and upper and lower retention lips extending inwardly from said upper and lower portions, respectively, into said channel.

13. The shade assembly of claim 7, wherein said lift cord extends vertically between said two or more batten clips and said vertical spacer stack formed by said spacers.

14. The shade assembly of claim 9, wherein said lift cord extends through said two or more coupling members at said location between said back side of said shade fabric and said vertical spacer stack.

15. A shade assembly, comprising:

a shade fabric having a front side and a back side;

a lift cord positioned along said back side of said shade fabric;

first and second battens coupled to said shade fabric at spaced apart locations;

first and second batten clips, said first batten clip being configured to couple said first batten to said shade fabric and said second batten clip being configured to couple said second batten to said shade fabric;

first and second batten spacers, said first batten spacer being coupled to said first batten clip and said second batten spacer being coupled to said second batten clip, said first and second batten spacers being substantially horizontally aligned along said back side of said shade fabric; and wherein:

said first and second batten spacers are configured to vertically engage one another to form a vertical spacer stack along said back side of said shade fabric when said shade fabric is moved to an opened position said lift cord extends vertically past said first and second batten spacers outside of said vertical spacer stack formed by said first and second batten spacers at a location between said first and second batten clips and said vertical spacer stack when said shade fabric is moved to the opened position.

16. A shade assembly as in claim 15, wherein said first batten spacer extends heightwise between a top end and a bottom end and defines a height between said top and bottom ends, said height being substantially equal to or greater than an effective stacking height of said first batten.

17. A shade assembly as in claim 15, further comprising a first coupling member coupled between said first batten clip and said first batten spacer.

18. A shade assembly as in claim 17, wherein said first coupling member includes a spacer-engaging portion and a clip-engaging portion extending outwardly from said spacer-engaging portion, said spacer-engaging portion configured to be received within a channel defined between upper and lower portions of said first batten spacer, said clip-engaging portion configured to be received within a track defined by said first batten clip.

19. A shade assembly, comprising:

a. shade fabric having a front side and a back side;

a lift cord positioned along said back side of said shade fabric;

first and second battens coupled to said shade fabric at spaced apart locations;

first and second batten clips, said first batten clip being configured to couple said first batten to said shade fabric and said second batten clip being configured to couple said second batten to said shade fabric;

first and second batten spacers, said first batten spacer being coupled to said first batten clip and said second batten spacer being coupled to said second batten clip, said first and second batten spacers being substantially horizontally aligned along said back side of said shade fabric;

a first coupling member coupled between said first batten clip and said first batten spacer; and wherein:

said first and second batten spacers are configured to vertically engage one another to form a vertical spacer stack along said back side of said shade fabric when said shade fabric is moved to an opened position said lift cord extends vertically past said first and second batten spacers at a location outside of said vertical spacer stack formed by said first and second batten spacers when said shade fabric is moved to the opened position.

20. A shade assembly as in claim 19, wherein said first batten spacer extends heightwise between a top end and a bottom end and defines a height between said top and bottom ends, said height being substantially equal to or greater than an effective stacking height of said first batten.

21. A shade assembly as in claim 19, wherein said first coupling member includes a spacer-engaging portion and a clip-engaging portion extending outwardly from said spacer-engaging portion, said spacer-engaging portion configured to be received within a channel defined between upper and lower portions of said first batten spacer, said clip-engaging portion configured to be received within a track defined by said first batten clip.

22. The shade assembly of claim 15, wherein said lift cord extends vertically along said back side of said shade fabric between said first and second batten clips and said vertical spacer stack formed by said first and second batten spacers.

* * * * *